US007887178B2

(12) United States Patent
Moon

(10) Patent No.: US 7,887,178 B2
(45) Date of Patent: Feb. 15, 2011

(54) TRANSFERRING APPARATUS FOR LIQUID MATERIAL SPRAY PRINTER

(75) Inventor: Hyung-Dae Moon, Seoul (KR)

(73) Assignee: Brain Union System Co., Ltd. (KR)

( * ) Notice: Subject to any disclaimer, the term of this patent is extended or adjusted under 35 U.S.C. 154(b) by 1122 days.

(21) Appl. No.: 11/597,238

(22) PCT Filed: May 17, 2005

(86) PCT No.: PCT/KR2005/001448

§ 371 (c)(1),
(2), (4) Date: Nov. 20, 2006

(87) PCT Pub. No.: WO2005/113160

PCT Pub. Date: Dec. 1, 2005

(65) Prior Publication Data

US 2008/0018726 A1 Jan. 24, 2008

(30) Foreign Application Priority Data

May 20, 2004 (KR) ..... 10-2004-0036043

(51) Int. Cl.
*B41J 2/01* (2006.01)

(52) U.S. Cl. ..... 347/104

(58) Field of Classification Search ..... 347/104; 101/474

See application file for complete search history.

(56) References Cited

U.S. PATENT DOCUMENTS 4,561,352 A * 12/1985 Svyatsky et al. ..... 101/2
4,930,912 A * 6/1990 Speicher ..... 400/48
6,158,909 A 12/2000 McCue, Jr. et al.
6,203,223 B1 3/2001 Nakayama et al.
6,217,145 B1 4/2001 Ito et al.
6,257,783 B1 7/2001 Hanaoka et al.

* cited by examiner

*Primary Examiner*—Matthew Luu
*Assistant Examiner*—Kendrick X Liu
(74) *Attorney, Agent, or Firm*—The Farrell Law Firm, P.C.

(57) ABSTRACT

Disclosed is a transferring apparatus for a liquid material spray printer, which prevents shaking of a transferring table generated when the transferring table on which a subject to be coated is mounted is reciprocating. The transferring apparatus includes a flat table; a pinion gear installed to the flat table to transfer a driving force; a support roller installed to the flat table and having magnetism; and a transferring table installed to an upper portion of the flat table and supported by the support roller. A rack gear to be engaged with the pinion gear is installed to a lower surface of the transferring table to reciprocate within a range so that liquid material sprayed from a spray assembly is coated on a surface of the subject. Thus, shaking of the transferring table is prevented due to the magnetism of the support roller while the transferring table is reciprocating.

7 Claims, 4 Drawing Sheets

[Fig. 1]
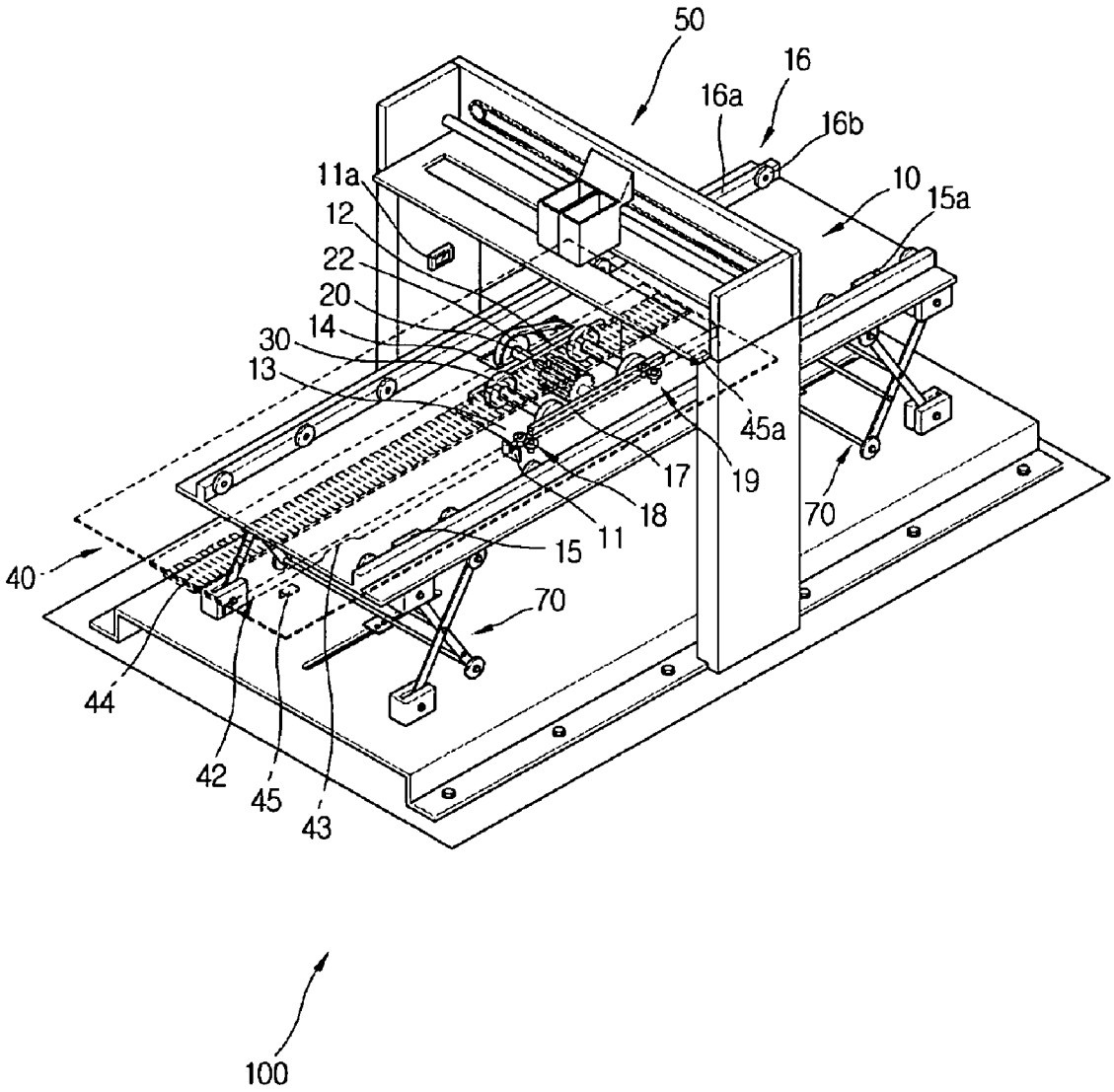
[Fig. 2]
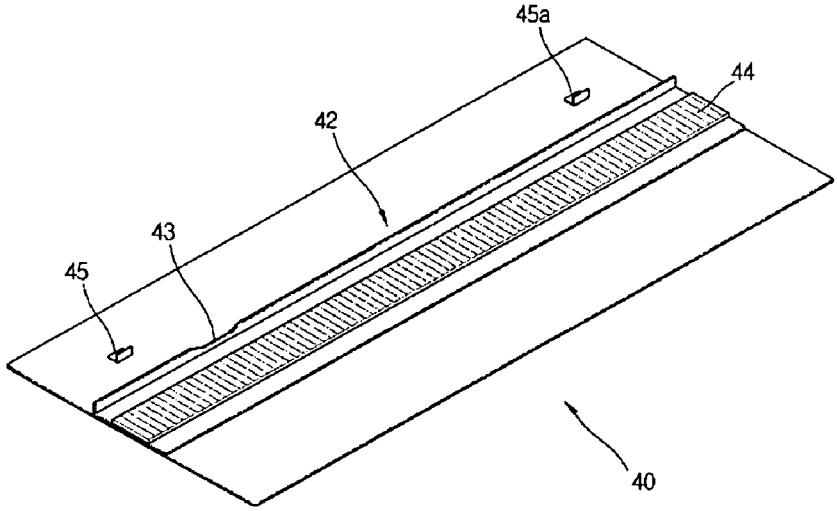

[Fig. 3]
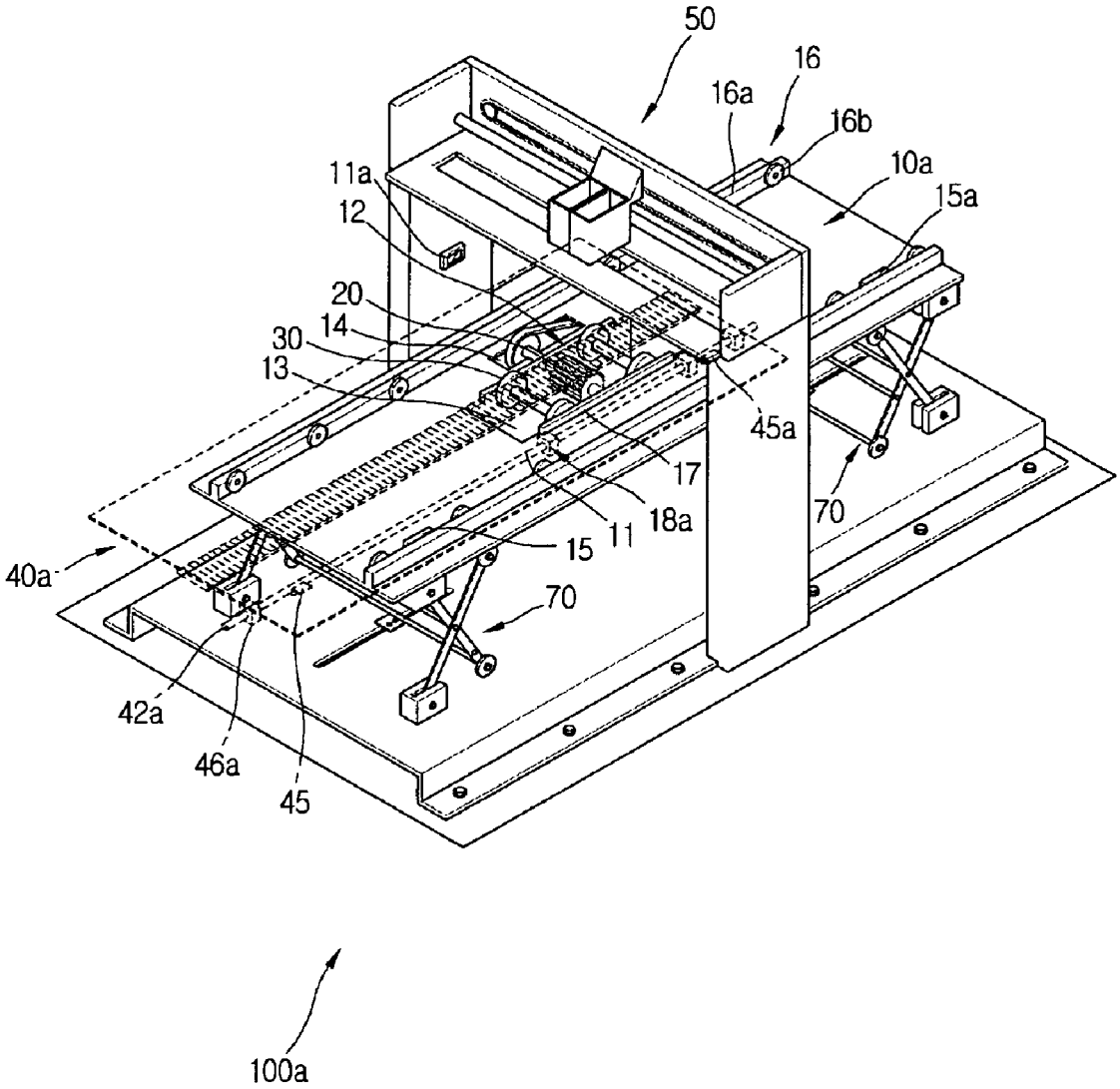
[Fig. 4]
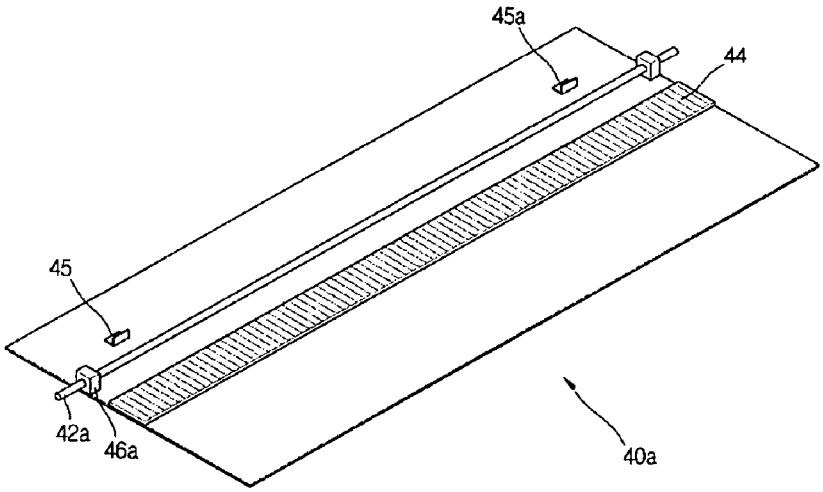

[Fig. 5]
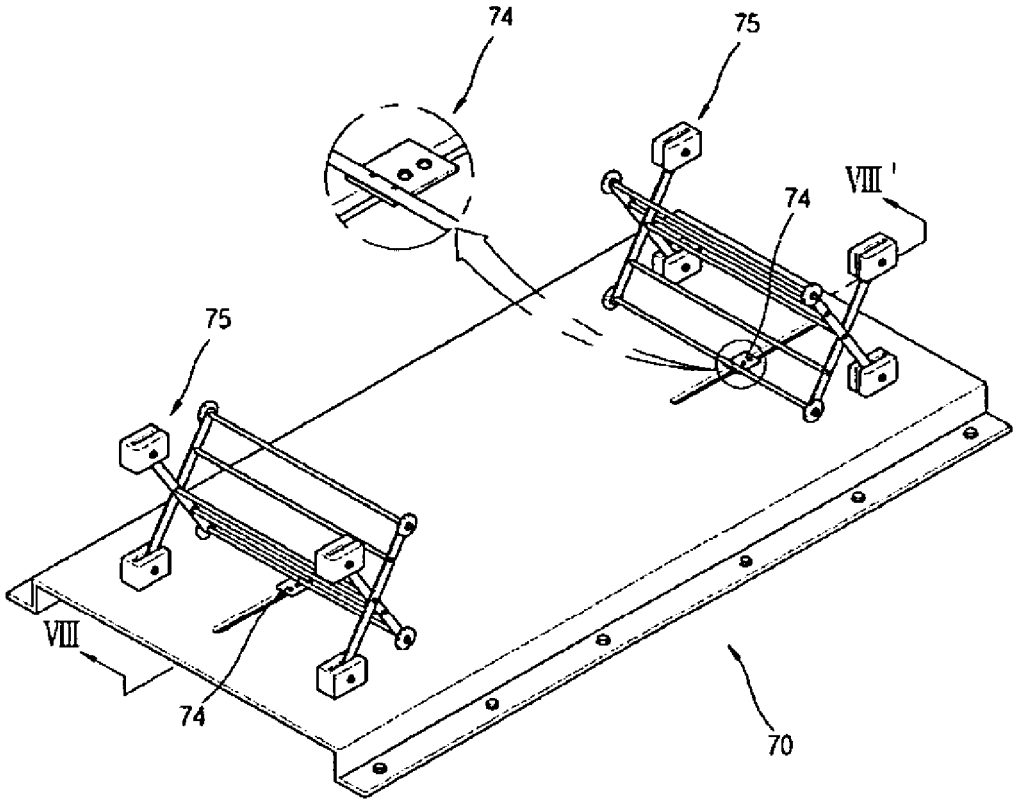
[Fig. 6]
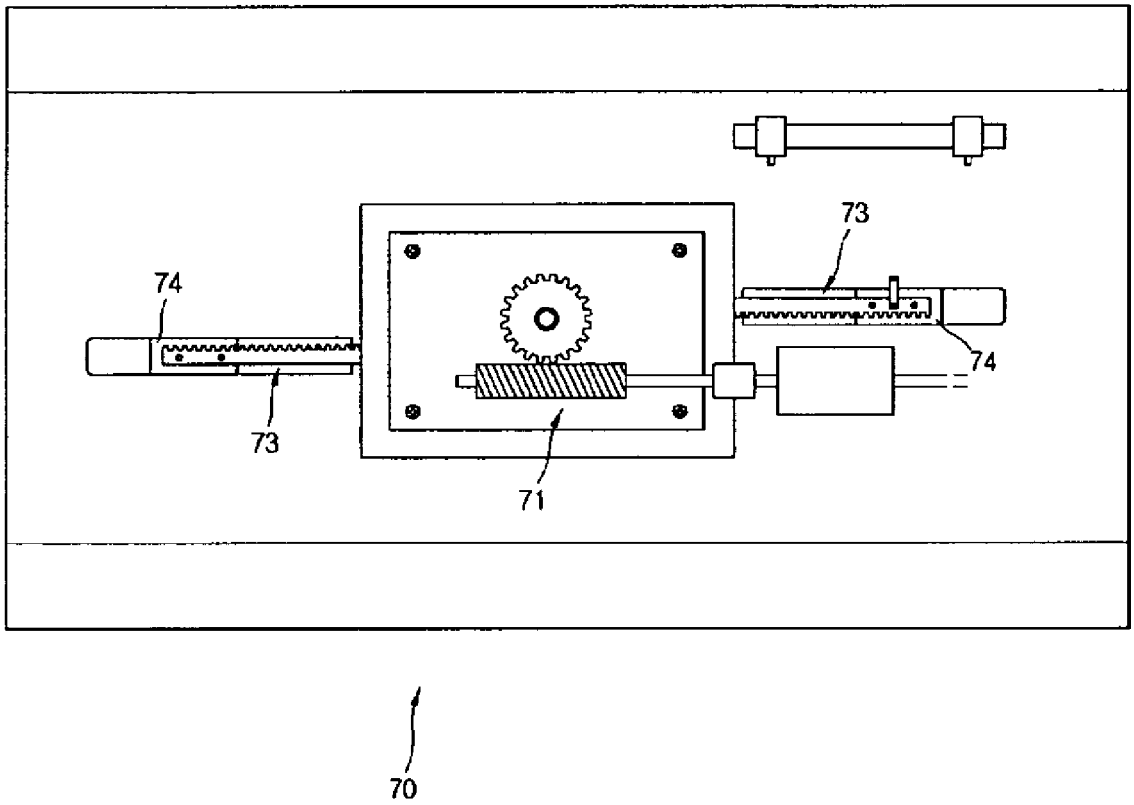

[Fig. 7]
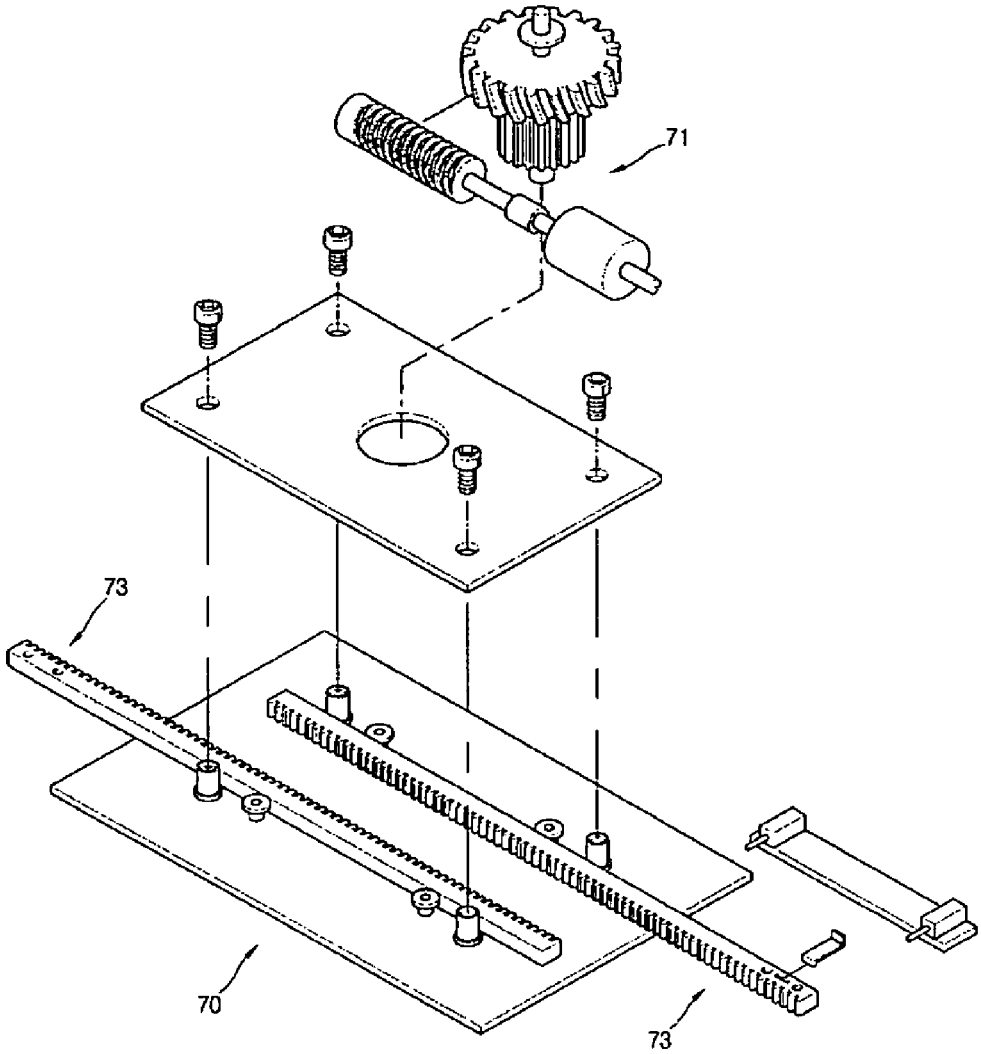
[Fig. 8]
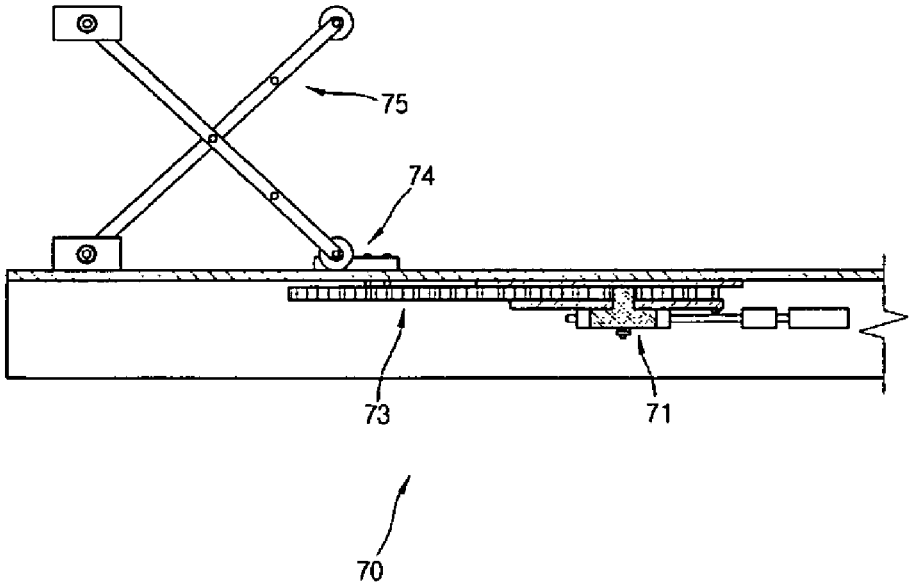

TRANSFERRING APPARATUS FOR LIQUID MATERIAL SPRAY PRINTER

TECHNICAL FIELD

The present invention relates to a transferring apparatus for a liquid material spray printer, and more particularly to a transferring apparatus for a liquid material spray printer, which prevents shaking of a transferring table that may be generated when the transferring table on which a subject to be coated is mounted is reciprocating.

BACKGROUND

Generally, a liquid material spray printer is a device for coating liquid material on a surface of a subject to print a predetermined image. As an example of such a liquid material spray printer, there is an ink-jet printer that may coats an ink material for printing.

The liquid material spray printer includes a moving table on which a subject to be coated is mounted, a transferring device for reciprocating the moving table so that liquid material may be coated on the subject, a lifting device for lifting the transferring device to a height suitable for liquid material coating, and a spray assembly installed at a substantial center of the transferring device to be capable of reciprocating in a direction perpendicular to a moving direction of the moving table. The spray assembly contains liquid material and is provided with a nozzle capable of spraying the liquid material to the subject to be coated. Such a liquid material spray printer is disclosed in Korean Utility Model Registration No. 20-0292979 as an example.

A subject mounted on the upper surface of the transferring table is moved below the spray assembly by means of the transferring device, and then lifted up to a height suitable for liquid material coating by means of the lifting device. Subsequently, the spray assembly coats liquid material to form a predetermined image on the subject.

However, the transferring table may be shaken as the transferring device reciprocates. That is to say, there arises a problem that the transferring table is shaken up and down or right and left. Such shaking of the transferring table may be an obstacle to realizing an exact image on the surface of the subject, and make it impossible to form exact printing. In particular, in case the transferring table moves at a high speed, such shaking may become worse.

DISCLOSURE OF INVENTION

Technical Problem

The present invention is designed to solve the problems of the prior art, and therefore an object of the invention is to provide a transferring apparatus for a liquid material spray printer, which enables to print an exact image on a subject by making a transferring table, on which a subject to be coated is mounted, not be shaken.

Technical Solution

In order to accomplish the above object, the present invention provides a transferring apparatus for a liquid material spray printer, which includes a flat table; a pinion gear installed to the flat table to transfer a driving force; a support roller installed to the flat table and having a predetermined magnetism; and a transferring table installed to an upper portion of the flat table and supported by the support roller, wherein a subject to be coated is mounted on an upper surface of the transferring table and a rack gear to be engaged with the pinion gear is installed to a lower surface of the transferring table to reciprocate within a predetermined range so that a liquid material sprayed from a spray assembly is coated on a surface of the subject, whereby shaking of the transferring table is prevented due to the magnetism of the support roller while the transferring table is reciprocating.

Preferably, the transferring table further includes a metal guide member installed to the lower surface of the transferring table to protrude in a length direction thereof, the flat table further includes a pair of first guide rollers installed with a predetermined interval so that the guide member is inserted and guided therein to be capable of reciprocating, and one of the pair of first guide rollers has a predetermined magnetism so that the transferring table is not shaken during reciprocating by means of the magnetism of the first guide roller.

More preferably, the flat table further includes a pair of second guide rollers installed with a predetermined distance from the first guide rollers along a moving direction of the transferring table, one of the pair of second guide rollers has a pre-determined magnetism, and the pair of second guide rollers are installed with a pre-determined interval so that the guide member is inserted and guided therein to be capable of reciprocating between the pair of second guide rollers, thereby preventing the transferring table from shaking during reciprocating.

In addition, it is preferred that the transferring table further includes a guide rod mounted on the lower surface thereof in a length direction, the flat table further includes a support member having an insert groove in which the guide rod is inserted to be capable of reciprocating therein, and the guide rod is supported by the support member so as to prevent the transferring table from shaking during reciprocating.

Here, the transferring apparatus may further include a sensing member for sensing reciprocation of the transferring table; and a controller for controlling operation of the pinion gear according to a signal from the sensing member, wherein the transferring table further includes protrusions formed at both ends thereof, and wherein, when the sensing member senses the protrusions, the controller stops operation of the pinion gear.

Preferably, the transferring apparatus for a liquid material spray printer further includes a roller unit installed to both side ends of the flat table along a length direction of the transferring table so as to support both side ends of the transferring table.

More preferably, the flat table has a perforation with a predetermined size, and the pinion gear and the support roller are respectively installed in the perforation.

BRIEF DESCRIPTION OF THE DRAWINGS

These and other features, aspects, and advantages of preferred embodiments of the present invention will be more fully described in the following detailed description, taken accompanying drawings. In the drawings:

FIG. 1 is a perspective view showing a liquid material spray printer to which a transferring apparatus for a liquid material spray printer according to a preferred embodiment of the present invention is installed;

FIG. 2 is a perspective view showing a transferring table of the transferring apparatus for a liquid material spray printer according to a preferred embodiment of the present invention;

FIG. 3 is a perspective view showing a liquid material spray printer to which a transferring apparatus for a liquid material spray printer according to another embodiment of the present invention is installed;

FIG. 4 is a perspective view showing a transferring table of the transferring apparatus for a liquid material spray printer according to another embodiment of the present invention;

FIG. 5 is a perspective view showing a lifting device of the liquid material spray printer of FIG. 1;

FIG. 6 is a bottom view showing the lifting device of FIG. 5;

FIG. 7 is an exploded perspective view showing the lifting device of FIG. 6; and FIG. 8 is a sectional view taken along VIII-VIII line of FIG. 5.

BEST MODE FOR CARRYING OUT THE INVENTION

The present invention will be described in detail referring to the drawings the terms used should not be construed as limited to general and dictionary meanings but based on the meanings and concepts of the invention on the basis of the principle that the inventor is allowed to define terms appropriate for the best explanation. Therefore, the description herein the scope of the invention be understood that other and modifications could be made thereto without departing from the spirit and scope of the invention.

FIG. 1 is a perspective view showing a liquid material spray printer to which a transferring apparatus for a liquid material spray printer according to a preferred embodiment of the present invention is installed, and FIG. 2 is a perspective view showing a transferring table of the transferring apparatus.

Referring to FIGS. 1 and 2, the transferring apparatus 100 for a liquid material spray printer includes a flat table 10, a pinion gear 20 and a support roller 30 installed to the flat table 10, and a transferring table 40 receiving a driving force from the pinion gear 20 to reciprocate.

The flat table 10 includes a perforation 12 formed at its center and a roller unit 16 installed to its both side ends. The flat table 10 is made of metal. Meanwhile, the term 'metal' used in this specification is defined to have property capable of being adhered by magnetic force.

The perforation 12 includes a first perforation 13 in which the pinion gear 20 and the support roller 30 are installed, and a second perforation 14 in which a pulley 22 for transferring a driving force to the pinion gear 20 is installed. The pinion gear 20, the support roller 30 and the pulley 22 will be described in detail later. Meanwhile, FIG. 1 shows that the flat table 10 has the first and second perforations 13, 14 separately for installing the pinion gear 20, the support roller 30 and the pulley 22 independently, but it is also possible that the pinion gear 20, the support roller 30 and the pulley 22 are all installed in one perforation.

Preferably, at a position near the first perforation 13, a shaft support 17 is installed so that shafts of the pinion gear 20 and the support roller 30 may be mounted along a moving direction of the transferring table 40. The shaft support 17 stably supports the shafts of the pinion gear 20 and the support roller 30.

The roller unit 16 includes supports 16*a* mounted to both side ends of the flat table 10 along a moving direction of the transferring table 40, and sliding rollers 16*b* installed to the supports 16*a* to support the transferring table 40. The roller unit 16 supports both side ends of the transferring table 40 so that the transferring table 40 may reciprocate in a smooth and stable way.

Preferably, the flat table 10 has a pair of first guide rollers 18 installed with a pre-determined interval so that a metal guide member 42, described later, may be inserted therein to be capable of reciprocating. One of the pair of first guide rollers 18 has magnetism with a predetermined magnetic force. That is to say, as the metal guide member 42 passes between the pair of first guide rollers 18 installed with an interval that allows the guide member 42 to substantially pass through it, the guide member 42 is adhered to the first guide roller 18 due to the magnetic force, thereby preventing the transferring table 40 from shaking.

More preferably, the flat table 10 has a pair of second guide rollers 19 installed along a moving direction of the transferring table 40 with a predetermined distance from the first guide rollers 18. The pair of second guide rollers 19 are installed with an interval that allows the guide member 42 to substantially pass through it, and one of them has magnetism with a predetermined magnetic force. That is to say, the metal guide member 42 is adhered to the second guide rollers 19 by means of the magnetic force, so shaking of the transferring table 40 is prevented.

The pinion gear 20 transfers a driving force from a driving motor (not shown) to a rack gear 44 of the transferring table 40. The pinion gear 20 is installed in the first perforation 13 so that it is partially protruded from the flat table 10. It makes the pinion gear 20 be engaged with the rack gear 44.

The support roller 30 is a roller having a predetermined magnetism, and the support roller 30 is installed in the first perforation 13 to support reciprocation of the transferring table 40. The support roller 30 is partially protruded from the flat table 10 so as to support the transferring table 40 when the rack gear 44 is engaged with the pinion gear 20.

Since the support roller 30 has magnetism, the metal transferring table 40 may be closely contacted with the support roller 30. That is to say, it may prevent the reciprocating transferring table 40 from shaking. In addition, when it is intended to print a predetermined image on a subject such as a paper with a different size, the transferring table 40 may be easily exchanged. That is to say, an external force capable of overcoming the magnetic force of the support roller 30 is applied to separate the transferring table 40, and then another transferring table 40 with a different size may be installed.

The transferring table 40 is a metal flat plate that is installed so as to be supported by the support roller 30, and it is coupled to the support roller 30 by magnetism. That is to say, the transferring table 40 is closely contacted with the support roller 30 by magnetism, thereby preventing the transferring table 40 from shaking.

A subject (not shown) to be coated is mounted on the upper surface of the transferring table 40, and the rack gear 44 to be engaged with the pinion gear 20 is installed to its lower surface along its length. That is to say, the transferring table 40 receives a driving force from the pinion gear 20 to move within a predetermined range together with allowing a predetermined image to be formed on the subject mounted on its upper surface.

The transferring table 40 preferably includes protrusions 45, 45*a* formed at both ends of its lower surface. The protrusions 45, 45*a* are used for controlling reciprocation of the transferring table 40 together with sensing members 15, 15*a* That is to say, if the first sensing member 15 installed to the flat table 10 senses the second protrusion 45*a*, the transferring table 40 stops rearward movement. Meanwhile, if the second sensing member 15*a* senses the first protrusion 45, the transferring table 40 stops advancing. Thus, the reciprocation of the transferring table 40 is controlled not to depart from the flat table 10.

Preferably, the transferring table 40 further includes a metal guide member 42 installed to protrude from its lower surface in a length direction thereof. As the transferring table 40 moves, the guide member 42 is inserted between the pair of first guide rollers 18 and the pair of second guide rollers 19 respectively. At this time, as mentioned above, the metal guide member 42 is closely contacted with the first and second guide rollers 18, 19 by means of magnetic force of the first and second guide rollers 18, 19. That is to say, the magnetic force of the first and second guide rollers 18, 19 prevents the transferring table 40 from shaking.

As described above, the transferring table 40 is not shaken since it is closely contacted with the support roller 30 and the first and second guide rollers 18, 19 due to the magnetic force of the support roller 30 and the first and second guide rollers 18, 19.

More preferably, the guide member 42 has a concave groove 43 formed at a position corresponding to the subject mounted on its upper surface. The concave groove 43 and a sensor 11 sense a position of the subject and accordingly initiate or stop operation of a spray assembly 50.

Meanwhile, FIG. 3 is a perspective view showing a liquid material spray printer to which a transferring apparatus for a liquid material spray printer according to another embodiment of the present invention is installed, and FIG. 4 is a perspective view showing a transferring table of the transferring apparatus.

The transferring apparatus 100*a* for a liquid material spray printer includes a transferring table 40*a* having a guide rod 42*a* mounted to its lower surface, and a flat table 10*a* to which a support member 18*a* is installed so that the guide rod 42*a* may be inserted to be movable therein.

The transferring table 40*a* includes a guide rod 42*a* installed to its lower surface in a length direction of the transferring table 40*a*, and a fixing member 46*a* for fixing the guide rod 42*a*, as shown in FIG. 4.

The guide rod 42*a* is inserted into the support member 18*a* and prevents shaking of the transferring table 40*a*, which may arise when the transferring table 40*a* is reciprocating. The fixing member 46*a* fixes the guide rod 42*a* to the lower surface of the transferring table 40*a* The fixing member 46*a* is preferably installed at both ends of the guide rod 42*a* It allows obtaining a reciprocating range of the transferring table 40*a* to the maximum so that a larger subject may be printed.

The support member 18*a* is installed to the upper surface of the flat table 10*a* and has an insert groove formed in a moving direction of the transferring table 40*a*. The insert groove has a size so that the guide rod 42*a* may be inserted and guided therein to prevent the transferring table 40*a* from shaking. In addition, it is preferred that at least two support members 18*a* are installed. It facilitates supporting the guide rod 42*a* firmly along a moving direction of the transferring table 40*a*.

Meanwhile, a component in FIGS. 3 and 4 having the same reference numeral as in FIGS. 1 and 2 is identical to that of FIGS. 1 and 2 with the same function.

Now, operation of the transferring apparatus 100 for a liquid material spray printer according to a preferred embodiment of the present invention will be described. The transferring apparatus 100 is installed to and used for a liquid material spray printer, so operation of the liquid material spray printer is also described together.

First, a subject to be coated is mounted on the upper surface of the transferring table 40. At this time, the subject is preferably mounted to a position corresponding to the concave groove 43 formed on the guide member 42. In this case, the sensor 11 detects the position of the subject and controls operation of the spray assembly 50.

Subsequently, if a worker pushes an operation switch (not shown), a driving force is transferred to the rack gear 44 so that the transferring table 40 moves below the spray assembly 50. That is to say, the transferring table 40 advances to a position where the spray assembly 50 may print an image on the subject.

After the subject is moved below the spray assembly 50, a controller (not shown) and a height sensor 1 la sense an actual distance between the spray assembly 50 and the upper surface of the subject and then compare it with an optimal coating distance. After that, the lifting device 70 lifts the flat plate 10 as much as the difference.

The lifting device 70 includes a worm gear 71, a pair of sliding members 73 receiving a driving force from the worm gear 71, and a crosslink 75 moving vertically according to sliding movement of the sliding members 73, as shown in FIGS. 5 to 8.

The pair of sliding members 73 have gear teeth on their surfaces facing with each other. That is to say, if the worm gear 71 rotates, the pair of sliding members 73 slide in opposite directions. If the sliding members 73 slide, the crosslink 75 connected to the sliding members 73 via a connector 74 slides, and if the crosslink 75 slides, the flat table 10 installed to the upper portion of the crosslink 75 is moved vertically.

The vertical movement caused by the lifting device 10 is controlled by the height sensor 11*a* and the controller (not shown). That is to say, the height sensor 11*a* and the controller control the subject to be vertically moved to the optimal coating distance.

After the coating distance is optimally controlled by the lifting device 70, the spray assembly 50 starts printing. As the printing work is progressed, the transferring table 40 moves at a predetermined speed. At this time, since the metal transferring table 40 is closely contacted with the support roller 30 by magnetic force and the guide member 42 is closely contacted with the first and second guide rollers 18, 19 by magnetic force, the transferring table 40 is not shaken. Thus, it is possible to print an exact and precise image.

The printing work is completed if the sensor 11 detects the concave groove 43 formed at a position corresponding to the end of the subject. That is to say, if the sensor 11 senses the concave groove 43, the controller controls the spray assembly 50 to stop spraying the liquid material.

Then, if the second sensing member 15*a* detects the first protrusion 45, the controller stops transferring a driving force so that the transferring table 40 stops advancing. Subsequently, the driving motor (not shown) transfers a driving force reversely so that the transferring table 40 moves rearward to the printing start position. The rearward movement of the transferring table 40 is stopped when the first sensing member 15 senses the second protrusion 45*a*.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

As described above, the transferring apparatus for a liquid material spray printer according to the present invention may ensure printing an exact image by preventing the transferring table, on which a subject to be coated is mounted, from shaking during movement.

The invention claimed is:

1. A transferring apparatus for a liquid material spray printer, comprising:

a flat table;

a pinion gear installed to the flat table to transfer a driving force;

a support roller installed to the flat table and having a predetermined magnetism; and a transferring table installed to an upper portion of the flat table and supported by the support roller, wherein a subject to be coated is mounted on an upper surface of the transferring table and a rack gear to be engaged with the pinion gear is installed to a lower surface of the transferring table to reciprocate within a predetermined range so that a liquid material sprayed from a spray assembly is coated on a surface of the subject, whereby shaking of the transferring table is prevented due to the magnetism of the support roller while the transferring table is reciprocating.

2. The transferring apparatus for a liquid material spray printer according to claim 1, wherein the transferring table further includes a metal guide member installed to the lower surface of the transferring table to protrude in a length direction thereof, wherein the flat table further includes a pair of first guide rollers installed with a predetermined interval so that the guide member is inserted and guided therein and configured to reciprocate, and wherein one of the pair of first guide rollers has a predetermined magnetism so that the transferring table is not shaken during reciprocating by means of the magnetism of the first guide roller.

3. The transferring apparatus for a liquid material spray printer according to claim 2, wherein the flat table further includes a pair of second guide rollers installed with a predetermined distance from the first guide rollers along a moving direction of the transferring table, wherein one of the pair of second guide rollers has a predetermined magnetism, and wherein the pair of second guide rollers are installed with a predetermined interval so that the guide member is inserted and guided therein to be capable of reciprocating between the pair of second guide rollers, thereby preventing the transferring table from shaking during reciprocating.

4. The transferring apparatus for a liquid material spray printer according to claim 1, wherein the transferring table further includes a guide rod mounted on the lower surface thereof in a length direction, wherein the flat table further includes a support member having an insert groove in which the guide rod is inserted to be capable of reciprocating therein, and wherein the guide rod is supported by the support member so as to prevent the transferring table from shaking during reciprocating.

5. The transferring apparatus for a liquid material spray printer according to claim 3, further comprising:

a sensing member for sensing reciprocation of the transferring table; and a controller for controlling operation of the pinion gear according to a signal from the sensing member, wherein the transferring table further includes protrusions formed at both ends thereof, and wherein, when the sensing member senses the protrusions, the controller stops operation of the pinion gear.

6. The transferring apparatus for a liquid material spray printer according to claim 5, further comprising:

a roller unit installed to both side ends of the flat table along a length direction of the transferring table so as to support both side ends of the transferring table.

7. The transferring apparatus for a liquid material spray printer according to claim 6, wherein the flat table has a perforation with a predetermined size, and wherein the pinion gear and the support roller are respectively installed in the perforation.

* * * * *